US008246865B2

(12) United States Patent
Oreña Tesouro et al.

(10) Patent No.: US 8,246,865 B2
(45) Date of Patent: Aug. 21, 2012

(54) PROCESS FOR PRODUCING FIREPROOF VISCOSE

(75) Inventors: Javier Oreña Tesouro, Madrid (ES); Angel Barcedo Miro, Madrid (ES)

(73) Assignee: Viscocel, S.L., Madrid (ES)

( * ) Notice: Subject to any disclaimer, the term of this patent is extended or adjusted under 35 U.S.C. 154(b) by 0 days.

(21) Appl. No.: 13/203,431

(22) PCT Filed: May 20, 2009

(86) PCT No.: PCT/ES2009/000273

§ 371 (c)(1), (2), (4) Date: Sep. 14, 2001

(87) PCT Pub. No.: WO2010/133708

PCT Pub. Date: Nov. 25, 2010

(65) Prior Publication Data

US 2012/0036648 A1 Feb. 16, 2012

(30) Foreign Application Priority Data

May 19, 2009 (ES) ..... 200901249

(51) Int. Cl.
*C09K 21/00* (2006.01)
*D01F 2/06* (2006.01)

(52) U.S. Cl. ..... 252/601; 252/607; 264/187; 264/188

(58) Field of Classification Search ..... 252/601, 252/607; 264/187, 188

See application file for complete search history.

(56) References Cited

U.S. PATENT DOCUMENTS

2007/0205402 A1* 9/2007 Shrivastava et al. ..... 252/601
2010/0190402 A1* 7/2010 Tozzi-Spadoni et al. ..... 442/141

* cited by examiner

*Primary Examiner* — Eisa Elhilo
(74) *Attorney, Agent, or Firm* — Albert Bordas, P.A.

(57) ABSTRACT

The flame retardant viscose is obtained by adding silica to the viscose and subsequently fixing the silica to the fiber, such that the final flame retardant fiber will have regenerated cellulose and a silica polymer providing the fibers with flame retardant properties. Conventionally, the regeneration of the viscose mixture is carried out using zinc sulphate, while the final phase of washing of the fiber is accomplished using sulphuric acid. Both zinc and sulphuric acid are highly contaminating products from the environmental point of view. The invention consists, on the one hand, of replacing the zinc sulphate with aluminum sulphate and, on the other, of replacing the sulphuric acid with hydrogen peroxide or oxygenated water, this minimizing the contaminating effect of the process to an extraordinary extent.

4 Claims, No Drawings

PROCESS FOR PRODUCING FIREPROOF VISCOSE

OTHER RELATED APPLICATIONS

The present application is a PCT National Phase Application in U.S. of PCT/ES2009/000273, filed on May 20, 2009, which claims priority of ES application No. P 200901249, filed on May 19, 2009.

SUMMARY OF THE INVENTION

The main object of the present invention to provide a process for the manufacturing of flame retardant (FR) viscose that introduce a series of modifications in the conventional process by which viscose is obtained, in order to make the said process less contaminating from the environmental point of view, due precisely to the removal of the polluting components and additives.

BACKGROUND OF THE INVENTION

1. Field of the Invention

The present invention refers to a new process for the manufacturing of flame retardant (FR) viscose, this understood as being regenerated cellulose.

2. Description of the Related Art

The first flame retardant viscose fibre (regenerated cellulose) of which knowledge is available was produced in Finland by Kemira in 1991 and was commercialized under the name "Visil®", this becoming Avilón FR in recent years.

In recent years, other producers of flame retardant viscose have emerged, using the same technique as that utilized by Kemira.

This technique consists of producing the flame retardant viscose by adding silica to the viscose and subsequently fixing the silica to the fibre. By adding silica to the viscose, the final flame retardant fibre will incorporate regenerated cellulose and a silica polymer providing the fibre with flame retardant properties.

This silica polymer is fixed to the fibre by using aluminum sulphate in the subsequent bleachings of the latter, this allowing this type of fibre to maintain its flame retardant properties even after the aggressive action of alkaline detergents. The use of aluminum sulphate allows the flame retardant properties to be maintained over time.

The silica is proportioned over the viscose en masse, following a preliminary process of preparation. The raw material used is superneutral sodium silicate or soluble glass with a weighted gradation of 3.3/l. The manner in which this raw material is used is $3.3SiO_2 \times Na_2O$. This product is a viscous, transparent and colourless liquid that is alkaline in reaction and soluble in water at all proportions.

In order to avoid gelling or solidification, the aforementioned product is diluted in electrolytic soda, which is equally diluted.

Following the preparation of the silica, it is proportioned over the viscose en masse. The virgin or pure viscose has the following approximate composition:

Cellulose ($C_6H_{10}O_5$) at approximately 9.36% by weight.

Soda (NaOH) at approximately 5.5% by weight.

Carbon sulphide ($CS_2$) at approximately 3.5% by weight.

Water at approximately 81% by weight.

The proportioning of the additive must be such that the viscose mixture has a content of silica with respect to the cellulose in the viscose of approximately 50%.

The viscose mixture is then regenerated, for which the said viscose is extruded via very small diameter spinnerettes in a spinning bath, this promoting the coagulation of the viscose and the additive.

The conventional spinning bath over which the viscose is coagulated is known as a Muller bath and has the following composition:

| | |
|---|---|
| Density | 1305.0 gr/l |
| $H_2SO4$ | 120.0 gr/l |
| $SO_4Zn$ | 7.5 gr/l |
| $SO_4Na_2$ | 323.7 gr/l |
| $H_2O$ | 853.8 gr/l |
| Temp. | 48.0° C. |

The regenerated fibre is subjected to the action of a bleaching agent, specifically sodium hypochlorite (NmOCl) and subsequently washed with an antichlorine ($H_2SO_4$).

Although it provides satisfactory results, this process poses the problem of its contaminating effect, in particular due to the use of zinc in the coagulation bath and of sodium hypochlorite and sulphuric acid in the bleaching phase, since this implies the use of highly contaminating heavy metals and organochlorated compounds.

DETAILED DESCRIPTION OF THE PREFERRED EMBODIMENT

The process proposed with this invention follows the basic lines of the conventional procedure described previously but introduces a series of improvements through which, as has been pointed out above, the contamination generated by the process is drastically reduced.

More specifically, and in keeping with one of the characteristics of the invention, the fibre coagulation bath will use aluminum instead of the zinc conventionally used.

The zinc was conventionally incorporated in the coagulation bath in sulphate form ($SO_4Zn$), and in the case of this invention the aluminum is also supplied to the bath in the form of a sulphate, specifically in the form of aluminum sulphate "$Al_2(SO_4)3$".

In keeping with another of the characteristics of the invention, the fibre bleaching phase is carried out replacing the sodium hypochlorite and sulphuric acid used conventionally with oxygenated water ($H_2O_2$).

In view of these characteristics and as is self evident, by eliminating zinc, a heavy metal that is harmful to both the environment and persons, one of the effects sought, i.e. the reduction of environmental contamination, is achieved. Furthermore, the polysilica acid is better fixed to the fibranne in the form of a silica polymer, since the aluminum enters into contact with the polysilica acid at the beginning of regeneration of the cellulose, rapidly forming aluminum silicates that have proven to be resistant to the subsequent alkaline washing of the fibres.

As regards the use of oxygenated water for the washing of the fibre, it should also be pointed out that the fibre should be subjected to a bath with a concentration of 8 gr/l of oxygenated water and at a temperature of 50° C. for some 5 minutes.

EXAMPLE OF PERFORMANCE OF THE INVENTION

The process consists essentially of adding silica to the viscose and subsequently fixing this to the fibre, such that the latter will ultimately have regenerated cellulose and a silica polymer providing flame retardant properties.

The silica is proportioned over the viscose en masse, following a preliminary process of preparation. The raw material used is superneutral sodium silicate or soluble glass with a weighted gradation of 3.3/l.

In order to avoid the gelling or solidification of the viscose product, this product is divided using equally diluted electrolytic soda, such that the final concentration of silica ($SiO_2$) in the prepared product is 17% by weight, compared to the original concentration of 28%. To achieve this, the necessary quantity of 15% by weight NaOH is added. This 15% soda is prepared using electrolytic soda or 50% by weight soda and permutated water in order to avoid impurities in the preparation.

By way of an example, in order to prepare one liter of sodium silicate under conditions allowing for the proportioning of the viscose, it is necessary to use the following:

0.55 l of sodium silicate at 28% by weight (superneutral sodium silicate)

0.10 l of electrolytic or commercial soda (50% by weight)

0.35 l of permutated water

First, the soda diluted to 15% is prepared using 0.10 l of electrolytic soda and the 0.35 l of permutated water. Once this soda has been prepared, it is mixed with the 0.55 l of sodium silicate and homogenized, the conditions of the final product being such that it may be applied duly proportioned to the mass viscose.

On an industrial scale, large tanks are required to prepare these solutions, due to the high ratio of dosing with respect to the cellulose.

This is followed by the proportioning of the silica to the mass viscose.

The dosing of the additive must lead to a situation in which the final viscose mixture (virgin viscose plus additive) has a content of silica versus cellulose of approximately 50%.

To achieve this, the additive must be proportioned in accordance with the following ratio:

Additive/viscose ratio=24% (assuming that the virgin viscose used has a cellulose content of 9.36%).

This means that for every liter of viscose 0.24 l of additive should be incorporated, the additive being that described above.

Once the suitable proportion of silica/viscose has been defined, the result should be mixed and stirred in order to achieve as homogeneous a mixture as possible, thus preventing the appearance of air in the viscose that might subsequently hinder the spinnability of the viscose mixture. This may be performed in a tank fitted with an agitator.

A good degree of deaeration must be achieved, for which the viscose mixture may be treated using some system suitable for this purpose (vacuum system), the mixture being subjected to a high level of vacuum (−750 mmHg).

The regeneration phase of the viscose mixture is then performed, for which the mixture is coagulated in a spinning bath. This process of coagulation is also known as the "cellulose regeneration process".

The viscose is extruded through special spinnerettes with very small diameter orifices in a spinning bath in which, as has been pointed out above, the conventional zinc has been replaced with aluminum. More specifically, the composition of the aforementioned spinning bath is as follows:

| | |
|---|---|
| Density | 1305.0 gr/l |
| $H_2SO4$ | 120.0 gr/l |
| $Al_2(SO_4)3$ | 5 gr/l |
| $SO_4Zn$ | 7.5 gr/l |
| $SO_4Na_2$ | 323.7 gr/l |
| $H_2O$ | 853.8 gr/l |
| Temp. | 48.0° C. |

The silica polymer appears inside the filament of regenerated cellulose and measures less than 10 nanometers. The degree of abrasiveness of this fibre is low, less than that of matt or semi-matt fibre, due to the polymer being so small in dimension compared to the particles contributed by the titanium dioxide generally used to produce matt fibranne.

This polymer, and its correct dispersal in the filament of fibranne, will allow the flame retardant properties of the fibre to be adequate.

The content of silica with respect to cellulose+silica (what is known as fibre ash) should be 30 or 33%. The determination of the fibre ash is accomplished by subjecting it to a temperature of 750° C. for 90 minutes. The ratio of the initial weight of the fibre, following calcination, to the initial weight of the anhydrous fibre will indicate the ash content of the flame retardant fibre manufactured.

This content will make it possible to achieve an LOI (Limiting Oxygen Index) of 30-33%, this being the parameter most appreciated by the manufacturers of flame retardant fabrics. This indicator establishes the oxygen content that the medium must have in order for burning of the fibre to be possible. A high value of more than 30% represents a high resistance to the propagation of flames.

The polysilica acid is then fixed to the fibre in order to make it resistant to subsequent alkaline washing. For this purpose, the fibre is subjected to washing with aluminum sulphate.

The bath of aluminum sulphate must have a minimum content of 10 gr/l measured as alumina ($Al_2O_3$).

This bath should be used with the fibre already cut, in lengths that may range from 20 to 120 mm, and must be applied at high temperature, around 80° C., and prior to the sulphurising bath, in which sodium carbonate and sodium sulphide or soda may be used as the active agent.

The procedure concludes with the washing of the fibre, once this has been regenerated, this being subjected to an aluminum bath and a sulphurising bath with sodium carbonate.

This washing is accomplished through the action of a bleaching agent which, as has been pointed out above, consists of hydrogen peroxide or oxygenated water, such that the flame retardant fibre is left completely free from the chlorine used in conventional bleaching in the form of sodium hypochlorite.

In this respect, and as has been explained above, the fibre is subjected to the action of a bath of oxygenated water with a concentration of 8 gr/l and a temperature of 50° C. for 5 minutes (time for contact between the fibre and the oxygenated water).

What is claimed is:

1. A process for manufacturing flame retardant viscose by adding silica to a viscose and subsequently fixing said silica to a fibre, said process consisting of a first phase in which said silica is prepared, a second phase of proportioning of said silica and an addition of said silica to a mass viscose, a third phase of regeneration of the viscose mixture, the fixing of a polysilica acid and finally a phase of washing of the fibre, characterized by the fact that during said third phase of regeneration of the viscose mixture, in which said viscose is coagulated in a spinning bath, zinc sulphate ($SO_4Zn$) in said spinning bath is replaced with aluminum sulphate ($Al_2(SO_4)3$), while in said phase of washing of the fibre, said washing is performed through the use of hydrogen peroxide or oxygenated water ($H_2O_2$) after a phase of bleaching with sodium hypochlorite (NaOCl).

2. Process for the manufacturing of flame retardant viscose, in accordance with claim 1, further characterized in that said phase of washing of the fibre is performed in a bath with a concentration of said oxygenated water of 8 gr/l at a temperature of around 50° C. for some 5 minutes.

3. A process for manufacturing flame retardant viscose, comprising the steps of:

A) preparing said silica in a first phase;

B) proportioning and adding said silica to a mass viscose in a second phase to create a viscose mixture;

C) regeneration of said viscose mixture in a third phase;

D) fixing of a polysilica acid in a fourth phase to create a fibre; and

E) washing said fibre in a fifth phase; during said third phase, said viscose is coagulated in a spinning bath, whereby zinc sulphate ($SO_4Zn$) is replaced with aluminum sulphate ($Al_2(SO_4)3$), and during said fifth phase, said washing is performed with hydrogen peroxide or oxygenated water ($H_2O_2$) after a phase of bleaching with sodium hypochlorite (NaOCl).

4. The process for manufacturing flame retardant viscose set forth in claim 3, further characterized in that said washing of said fibre is performed with a concentration of said oxygenated water of 8 gr/l at a temperature of approximately 50° C. for approximately 5 minutes.

* * * * *